US005564406A

United States Patent [19]

Klein

[11] Patent Number: 5,564,406

[45] Date of Patent: Oct. 15, 1996

[54] METHOD FOR ADAPTING WARM-UP ENRICHMENT

[75] Inventor: Ralf Klein, Bad Wimpfen, Germany

[73] Assignee: Robert Bosch GmbH, Stuttgart, Germany

[21] Appl. No.: 588,608

[22] Filed: Jan. 19, 1996

[30] Foreign Application Priority Data

Jan. 19, 1995 [DE] Germany ..... 195 01 458.8

[51] Int. Cl.[6] ..... F02D 41/06

[52] U.S. Cl. ..... 123/681; 123/686; 123/687

[58] Field of Search ..... 123/681, 685, 123/686, 687, 689

[56] References Cited

U.S. PATENT DOCUMENTS

| | | | |
|---|---|---|---|
| 4,205,635 | 6/1980 | Kirn et al. | 123/491 |
| 4,787,357 | 11/1988 | Nishikawa et al. | 123/686 |
| 5,279,275 | 1/1994 | Freudenberg | 123/686 X |
| 5,483,946 | 1/1996 | Hamburg et al. | 123/686 |

*Primary Examiner*—Tony M. Argenbright

*Attorney, Agent, or Firm*—Walter Ottesen

[57] ABSTRACT

The invention is directed to a method of metering fuel to the engine during warm-up operation which precedes normal operation of the engine during which a first amount of fuel is metered to the engine. The engine is equipped with a lambda control and a device for detecting a variable suitable for distinguishing warm-up operation and normal operation of the engine. A predetermined corrective factor (FWL) is provided in dependence upon the variable. A second amount of fuel is metered to the engine during the warm-up operation which is increased by the corrective factor (FWL) so that the second amount is greater than the first amount. Lambda control is engaged during the warm-up operation and provides a desired lambda value ($\lambda_{des}$). A quantity is formed indicative of the mean deviation of the actual lambda value ($\lambda_{act}$) from the desired lambda value ($\lambda_{des}$) when the lambda control is engaged. The quantity is applied to increase the corrective factor (FWL) when the quantity indicates that the mean value of the actual lambda value ($\lambda_{act}$) is greater than the desired lambda value ($\lambda_{des}$) and decrease the corrective factor (FWL) when the quantity indicates that the mean value of the actual lambda value ($\lambda_{act}$) is less than the desired lambda value ($\lambda_{des}$).

11 Claims, 3 Drawing Sheets

METHOD FOR ADAPTING WARM-UP ENRICHMENT

FIELD OF THE INVENTION

The invention relates to the metering of fuel for an internal combustion engine after a cold start.

BACKGROUND OF THE INVENTION

After a cold internal combustion engine starts, a portion of the metered fuel condenses on areas in the induction pipe which are still cold and on the cylinders of the internal combustion engine. A further portion leaves the cylinders uncombusted with the exhaust gas as a consequence of inadequate vaporization before the ignition. The composition of the mixture which is combusted in this phase can become much leaner owing to these effects and this can lead to problems in the operating performance of the engine.

In order to avoid such problems, which include, for example, an unsatisfactory power output, juddering during acceleration or stalling during idling, the operating mixture in this phase is usually enriched with fuel as a function of time or temperature. Such a procedure is disclosed, for example, in U.S. Pat. No. 4,205,635. Here, a comparatively excessive enrichment is less critical for disturbance-free operation of the engine than enrichment which is too weak in comparison. In the time between the start of the internal combustion engine and the activation of a lambda control, which is usually less than a minute, the degree of optimum enrichment is also dependent on the properties of the fuel being used. These fuel properties can fluctuate regionally and in dependence on the time of year. A strictly controlled enrichment is customary to cover the entire range of fuel qualities which vary regionally and in dependence on the time of year. However, enrichment which exceeds the particular extent of enrichment required leads to increased emissions of toxic substances.

SUMMARY OF THE INVENTION

In view of the above, it is an object of the invention to provide a method which automatically adapts the controlled enrichment to the degree of enrichment actually needed.

The invention is directed to a method of metering fuel to the engine during warm-up operation thereof which precedes normal operation of the engine during which a first amount of fuel is metered to the engine. The engine is equipped with a lambda control and a device for detecting a variable suitable for distinguishing warm-up operation and normal operation of the engine. The method includes the steps of: providing a predetermined corrective factor (FWL) in dependence upon the variable; metering a second amount of fuel to the engine during the warm-up operation which is increased by the corrective factor (FWL) so that the second amount is greater than the first amount; engaging the lambda control during the warm-up operation and providing a desired lambda value ($\lambda_{des}$); forming a quantity indicative of the mean deviation of the actual lambda value ($\lambda_{act}$) from the desired lambda value ($\lambda_{des}$) when the lambda control is engaged; and, applying the quantity to increase the corrective factor (FWL) when the quantity indicates that the mean value of the actual lambda value ($\lambda_{act}$) is greater than the desired lambda value ($\lambda_{des}$) and decreasing the corrective factor (FWL) when the quantity indicates that the mean value of the actual lambda value ($\lambda_{act}$) is less than the desired lambda value ($\lambda_{des}$).

BRIEF DESCRIPTION OF THE DRAWINGS

The invention will now be explained in greater detail with reference to the drawings wherein.

DESCRIPTION OF THE PREFERRED EMBODIMENTS OF THE INVENTION

Figure 1:
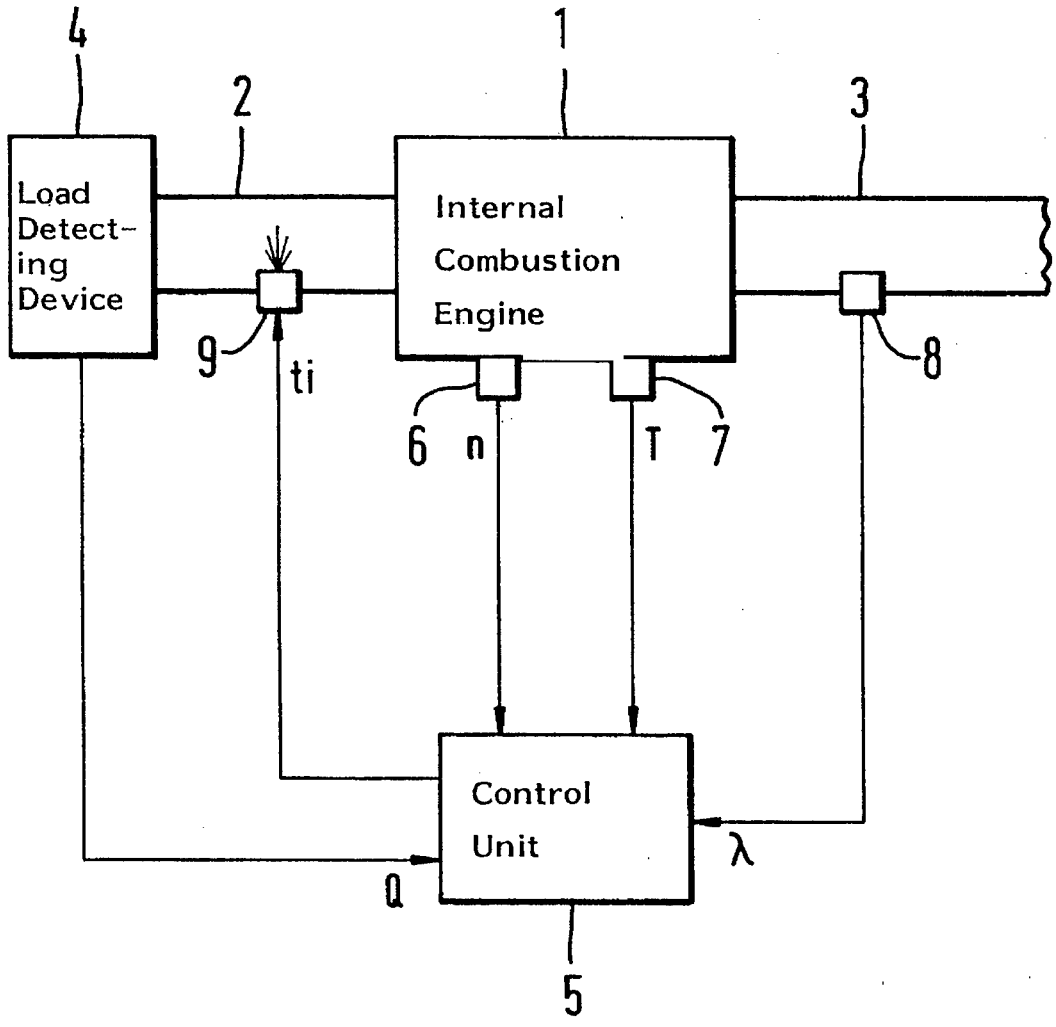
FIG. 1 shows the technical context of the invention.

In FIG. 1, reference numeral 1 identifies an internal combustion engine with an induction pipe 2 and an exhaust pipe 3. A load-detecting means 4 supplies to a control unit 5 a signal Q as to the quantity of air inducted by the internal combustion engine. Further sensors (6, 7, 8) supply to the control unit 5 signals relating to engine speed (n), temperature T and composition $\lambda$ of the exhaust gases of the engine. From these signals, the control unit 5 forms a fuel metering signal ti, for example an injection time pulse, with which a fuel injection valve 9 in the intake pipe is actuated.

Figure 2:
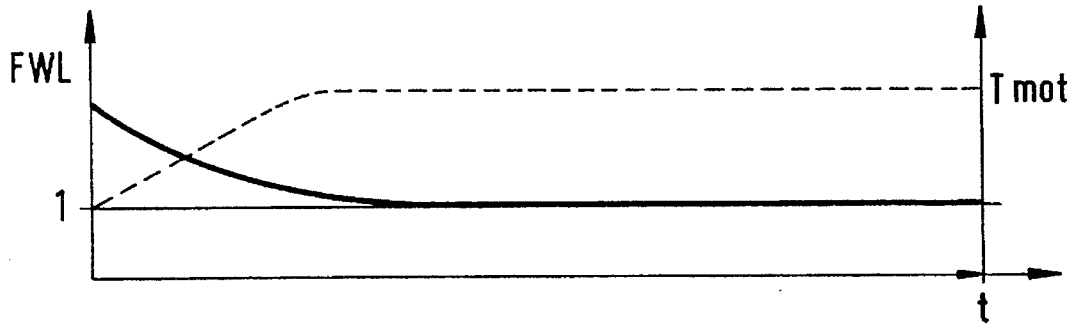
FIG. 2 illustrates, by way of example, the rise in the temperature Tmot of the engine as a function of time after a cold start and the variation of a warm-up factor FWL also as a function of time after a cold start.
Figure 3:
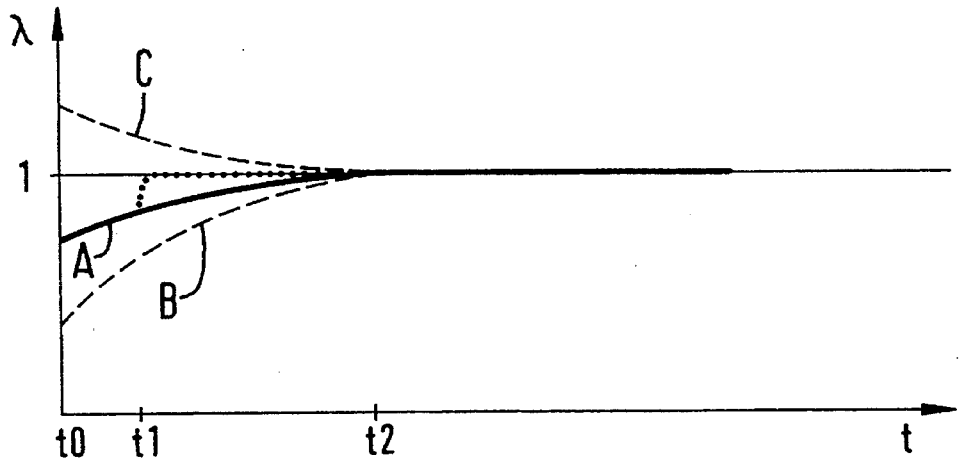
FIG. 3 shows the variation of the air ratio $\lambda$ as a function of time for various types of fuel after a cold start as known per se; and, FIG. 4 illustrates the invention in the form of function blocks which are logically interconnected.

The formation of the injection time pulse takes place, as known, in a closed-loop control circuit when the engine is operationally warm. The closed-loop control circuit operates essentially in such a way that a temporary injection pulse width t1 is corrected multiplicatively with a control factor FR which is formed as a function of the deviation of the exhaust gas composition $\lambda_{act}$ from a desired value $\lambda_{des}$. The temporary injection pulse width t1 is formed as a function of rotational speed (n) and load Q of the engine. The parameters of the closed-loop control circuit are fixed in such a way that, in the steady state, a desired exhaust gas composition, for example $\lambda=1$, is obtained. In contrast, after a cold start, the lambda control is usually not yet ready for operation. The metering of fuel then takes place in a controlled fashion and the temporary injection pulse width t1 is logically connected by multiplication to a correction factor FWL which has an enriching effect. The variation over time of such a correction value FWL is shown in FIG. 2 for the example of a multiplicative logical connection. The time point t=0 corresponds here to the time of a start with an engine which is still cold. In this respect, reference can be made to the broken-line curve in FIG. 2 which represents the temperature Tmot of the engine as a function of time (t). The factor FWL is initially significantly greater than 1 and therefore, since it is logically connected multiplicatively to t1, the factor FWL causes the injected quantity of fuel to increase. As heating increases, the factor decreases and reaches the neutral value 1 when the internal combustion engine is operationally warm. The solid line A in FIG. 3 shows the exhaust gas composition $\lambda_{act}$ which is obtained for a specific type of fuel. As can be concluded from the initial values $\lambda<1$, the controlled enrichment outweighs the leaning effects, mentioned at the outset, for the fuel A.

Other fuels can, however, lead to other lambda profiles as exemplified by the broken-line curves B and C in FIG. 3. All the curves having in common that, for times t>t2, they all coincide in leading to $\lambda=1$. Stated otherwise, the differences in $\lambda$, which result from different fuel qualities, are limited to the warm-up region. For the fuel B, the precontrolled enrichment has an excessively enriching effect compared to fuel A; whereas, the precontrolled enrichment is not adequate for fuel C. The dotted line in FIG. 3 represents the lambda exhaust gas composition produced when there is an interaction of closed-loop control and warm-up enrichment. It is assumed here that a control readiness is possible starting from the time t1. Criteria for this are, for example, that the temperatures of the exhaust gas probe and the engine exceed predetermined threshold values. According to the invention, the behavior of the control in this range between t1 and t2, which reflects engine temperatures T1 and T2, is utilized to adapt the FWL precontrol to the particular type of fuel used.

Figure 4:
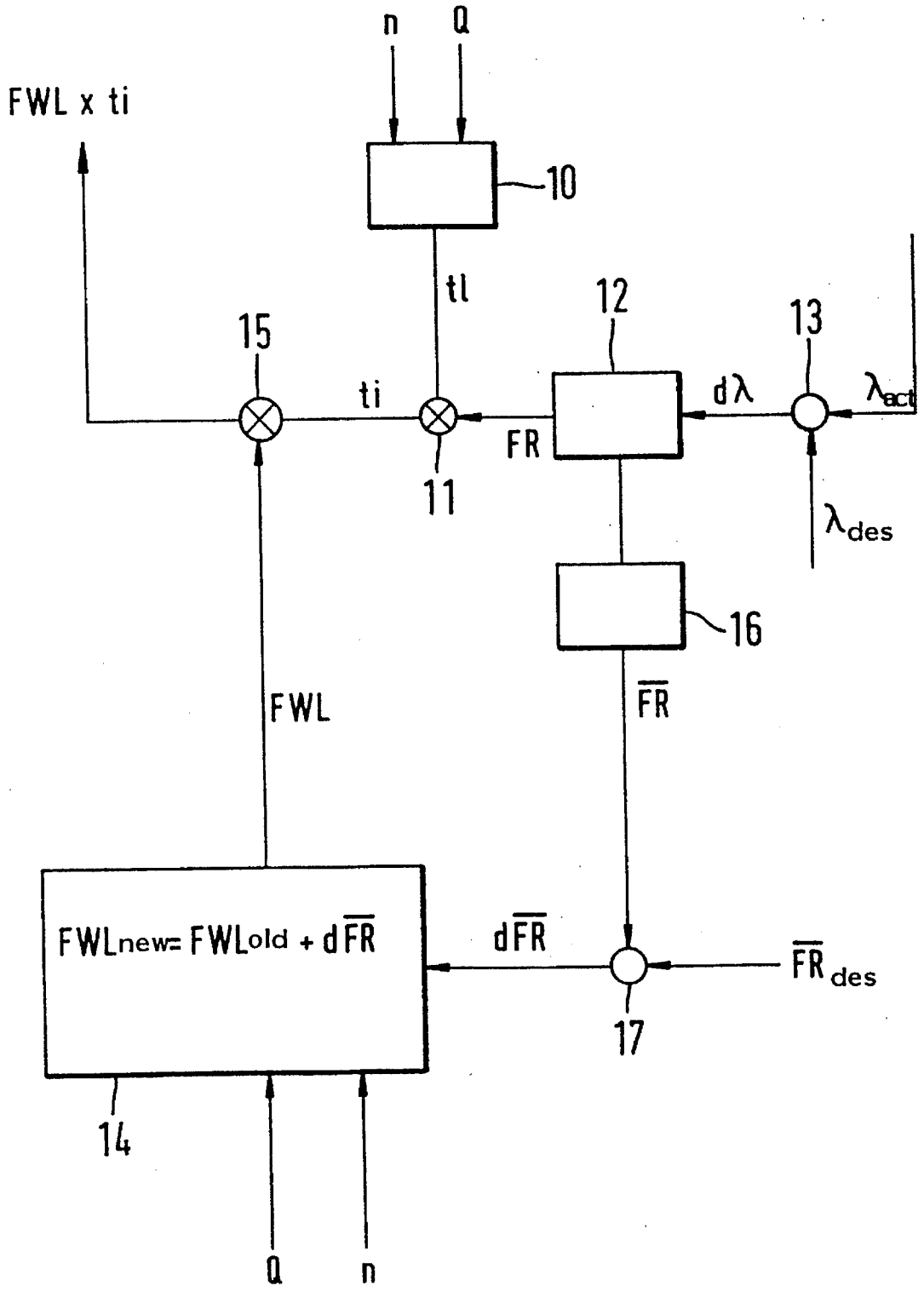

FIG. 4 illustrates the method of the invention with a diagram comprising function blocks which can be realized, for example, as modules of a program which runs in the control unit 5. When the engine is operationally warm, no warm-up enrichment is effective, which corresponds in this figure to a FWL value=1. In this case, the temporary injection pulse width t1 is formed in block 10 at least as a function of the engine speed (n) and the load Q of the engine. The numeral 11 symbolizes the logical connection of this precontrol value t1 to a control factor FR to form an injection pulse width ti. A factor FR is formed as a control variable of the lambda control in a controller block 12 as a function of the difference d$\lambda$ between the exhaust gas composition $\lambda_{act}$ and a desired value $\lambda_{des}$. The difference d$\lambda$ is formed by a comparison in block 13.

In FIG. 3, this function is obtained for times t>t1. Directly after a cold start (t<t1), the lambda control is inactive and FR is set, for example, to the neutral value 1. In this phase, the correction factor FWL, which decays as a function of time or temperature and is formed in the block 14, operates on t1 via the logical connection 15 as shown in FIG. 4. The formation of FWL can also be dependent, for example, on further characteristic operating variables of the engine, such as load and/or rotational speed (engine speed), so that individual warm-up factors FWL are formed for different load/rotational speed operating points of the engine. Thus, for example, a division of the load spectrum into at least three ranges with respective individual FWL values has proven advantageous.

The adaptation, according to the invention, of the warm-up factor FWL is carried out in the illustration of FIG. 3 in the range between t1 and t2, that is, when the lambda control is ready for operation and the engine is not yet operationally warm as shown in FIG. 4. The mean value $\overline{FR}$ is formed, for example from the control factor FR in block 16, as a measure of the mean deviation of the actual lambda value from a desired value and is compared to a desired value $FR_{des}$. This comparison is schematically represented by reference numeral 17 in FIG. 4. A deviation d$\overline{FR}$ always occurs whenever the currently acting warm-up factor FWL leads, in conjunction with the type of fuel used, to an incorrect lambda adaptation; that is, to $\lambda$ not equal to 1. An adaptation of the warm-up factor to the fuel used is carried out in that an adapted warm-up factor FWLnew is formed in the block 14 as a sum of the old warm-up factor FWLold and the deviation of the mean control factor d$\overline{FR}$. This adaptation, which is carried out successively in a prescribed time interval, leads, in the course of several cold starts, to a warm-up enrichment which is specific to the type of fuel.

In order to distinguish the warm-up operation from normal operation, the following variables are suitable, for example: a temperature in the region of the internal combustion engine, for example the temperature of the coolant or of the lubricant, or a temperature prevailing in the intake pipe of the engine; and, a measure of the quantity of heat converted inside the engine since the start, for example the time elapsed since the engine started or the quantity of fuel metered since the start or the total quantity of air inducted by the engine in this time.

The warm-up correction factor FWL can be determined, for example, from a characteristic curve stored in the control unit as a function of at least one of the above-mentioned variables.

It is understood that the foregoing description is that of the preferred embodiments of the invention and that various changes and modifications may be made thereto without departing from the spirit and scope of the invention as defined in the appended claims.

What is claimed is:

1. A method of metering fuel to the engine during warm-up operation thereof which precedes normal operation of the engine during which a first amount of fuel is metered to the engine, the engine being equipped with a lambda control and means for detecting a variable suitable for distinguishing warm-up operation and normal operation, the method comprising the steps of:

providing a predetermined corrective factor (FWL) in dependence upon said variable;

metering a second amount of fuel to said engine during said warm-up operation which is increased by said corrective factor (FWL) so that said second amount is greater than said first amount;

engaging said lambda control during said warm-up operation and providing a desired lambda value ($\lambda_{des}$);

forming a quantity indicative of the mean deviation of the actual lambda value ($\lambda_{act}$) from said desired lambda value ($\lambda_{des}$) when said lambda control is engaged; and, applying said quantity to increase said corrective factor (FWL) when said quantity indicates that the mean value of said actual lambda value ($\lambda_{act}$) is greater than said desired lambda value ($\lambda_{des}$) and decrease said corrective factor (FWL) when said quantity indicates that the mean value of said actual lambda value ($\lambda_{act}$) is less than said desired lambda value ($\lambda_{des}$).

2. The method of claim 1, further comprising the step of determining said corrective factor (FWL) from a characteristic line as a function of said variable.

3. The method of claim 1, wherein said corrective factor (FWL) is also dependent upon the load of the engine and/or the rpm of said engine.

4. The method of claim 3, wherein the load of the engine varies over a load spectrum; and, the method further comprising the step of subdividing said load spectrum into at least three subranges and forming individual corrective factors for said subranges, respectively.

5. The method of claim 1, said lambda control having a control variable (FR) and the method comprising the further step of forming a mean value ($\overline{FR}$) of said control variable (FR) as said quantity indicative of said mean deviation of said actual lambda value ($\lambda_{act}$).

6. The method of claim 1, further comprising the step of detecting a temperature in the region of said engine as said variable suitable for distinguishing warm-up operation and normal operation.

7. The method of claim 6, wherein the engine has a cooling system for circulating a coolant, a lubricating system having a lubricant and an intake pipe; and, wherein said temperature being selected from the group consisting of the temperature of said coolant, the temperature of said lubricant and the temperature present in said intake pipe.

8. The method of claim 1, further comprising the step of detecting the amount of heat converted within said engine since start-up thereof and utilizing said amount as said variable suitable for distinguishing warm-up operation and normal operation.

9. The method of claim 8, further comprising the step of measuring the time since said start-up as a quantity indicative of said amount of said heat which has been converted.

10. The method of claim 8, further comprising the step of measuring the amount of fuel metered to said engine since said start-up as a quantity indicative of said amount of said heat which has been converted.

11. The method of claim 8, further comprising the step of measuring the amount of air inducted into said engine since said start-up as a quantity indicative of said amount of said heat which has been converted.

* * * * *